US007981066B2

(12) United States Patent
Lewis

(10) Patent No.: US 7,981,066 B2
(45) Date of Patent: Jul. 19, 2011

(54) EXTERNAL PULSATION TREATMENT APPARATUS

(76) Inventor: Michael Paul Lewis, Houston, TX (US)

( * ) Notice: Subject to any disclaimer, the term of this patent is extended or adjusted under 35 U.S.C. 154(b) by 1120 days.

(21) Appl. No.: 11/420,133

(22) Filed: May 24, 2006

(65) Prior Publication Data

US 2007/0272250 A1 Nov. 29, 2007

(51) Int. Cl.
*A61H 31/00* (2006.01)

(52) U.S. Cl. ..... 601/152; 601/149; 601/143

(58) Field of Classification Search ..... 601/41–44, 601/132–134, 136, 143–153
See application file for complete search history.

(56) References Cited

U.S. PATENT DOCUMENTS

| | | | | |
|---|---|---|---|---|
| 891,181 | A | 6/1908 | Mitchell | |
| 1,868,452 | A * | 7/1932 | Whitney | 601/146 |
| 1,878,925 | A * | 9/1932 | Whitney | 601/146 |
| 2,473,598 | A * | 6/1949 | Leland | 335/228 |
| 3,303,841 | A | 2/1967 | Dennis | |
| 3,654,919 | A | 4/1972 | Birtwell | |
| 3,734,087 | A | 5/1973 | Sauer et al. | |
| 3,783,859 | A | 1/1974 | Sauer et al. | |
| 3,786,802 | A | 1/1974 | Hagopian et al. | |
| 3,835,845 | A | 9/1974 | Maher | |
| 3,862,629 | A | 1/1975 | Rotta | |
| 3,866,604 | A | 2/1975 | Curless et al. | |
| 3,878,839 | A | 4/1975 | Norton et al. | |
| 4,077,402 | A | 3/1978 | Benjamin, Jr. et al. | |
| 4,253,449 | A | 3/1981 | Arkans et al. | |
| 4,738,249 | A | 4/1988 | Linman et al. | |
| 4,753,226 | A | 6/1988 | Zheng et al. | |
| 5,000,164 | A | 3/1991 | Cooper | |
| 5,090,417 | A | 2/1992 | Mollan et al. | |
| 5,174,281 | A | 12/1992 | Lee | |
| 5,407,418 | A | 4/1995 | Szpur | |
| 5,554,103 | A | 9/1996 | Zheng et al. | |
| 5,769,800 | A | 6/1998 | Gelfand | |
| 5,997,540 | A | 12/1999 | Zheng et al. | |
| 6,010,471 | A | 1/2000 | Ben-Noon | |
| 6,076,013 | A | 6/2000 | Brennan et al. | |
| 6,078,235 | A | 6/2000 | Schebitz et al. | |
| 6,620,116 | B2 * | 9/2003 | Lewis | 601/41 |
| 6,736,785 | B1 | 5/2004 | Van Brunt | |
| 2003/0004445 | A1 * | 1/2003 | Hall et al. | 601/41 |
| 2004/0073146 | A1 * | 4/2004 | Weintraub et al. | 601/134 |
| 2004/0116840 | A1 * | 6/2004 | Cantrell et al. | 601/44 |
| 2006/0074361 | A1 * | 4/2006 | Zicherman | 601/144 |
| 2006/0074362 | A1 * | 4/2006 | Rousso et al. | 601/152 |
| 2008/0097268 | A1 * | 4/2008 | Rousso | 602/13 |

* cited by examiner

*Primary Examiner* — Justine R Yu
*Assistant Examiner* — Valerie Skorupa
(74) *Attorney, Agent, or Firm* — Keeling Patents & Trademarks LLC; Melissa M. Martinez; Kenneth A. Keeling

(57) ABSTRACT

There is provided a non-invasive pulsation and counterpulsation medical treatment apparatus for treating reduced cardiac output in heart patients. A flexible cuff is passed over the patient's lower body and/or extremities, and is attached through a lever arm to an electromechanical actuator. Through a mechanical linkage, the actuator sequentially tensions and releases the cuff, thereby sequentially compressing and releasing pressure on the patient, and thereby augmenting the patient's blood pressure. The actuator includes an electric solenoid which axially extends and retracts a shaft. The shaft oscillates the lever arm. A curved plate on the apparatus supports the patient's body or extremity in a fixed position during the treatment. A pressure sensor in the cuff transmits pressure data to an operator or electronic processor. Based on physiological data continuously obtained from the patient, various treatment parameters may be changed during the patient's treatment by an attending clinician or by a computer processor controlling the treatment.

23 Claims, 10 Drawing Sheets

EXTERNAL PULSATION TREATMENT APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to medical treatment devices, and, more particularly, to a pulsation treatment apparatus for treating reduced cardiac output in patients.

2. Description of the Related Art

There are a variety of medical conditions in which the heart cannot pump sufficient blood to meet the body's normal requirements for nutrients and oxygen. Congestive heart failure is one such condition in which the heart cannot pump enough blood to meet the needs of the body's other organs. Cardiac output can be too low for a variety of reasons, including coronary artery disease, endocarditis and myocarditis, diabetes, obesity, past heart attacks, high blood pressure, congenital defects, valve disease, or thyroid disease, to name a few. When cardiac output falls, blood returning to the heart through veins can accumulate before it reaches the heart, causing fluid accumulation in the tissues. When cardiac output is too low, the body may take compensatory action including retention of salt by the kidneys. In response to salt retention, the body may retain greater quantities of water to balance sodium, and excess fluids can escape from the circulatory system causing edema (swelling) in other parts of the body. Edema is one of many complications arising from reduced cardiac output and congestive heart failure. The present invention is useful in treating edema, congestive heart failure and reduced cardiac output. Coronary artery disease is another condition that results in insufficient quantities of blood being pumped. Angina pectoris is a condition resulting from coronary artery disease. The present invention is useful in treating both coronary artery disease and angina pectoris.

Various prior art devices have been tried for treating heart patients by means of non-invasive pulsation and counterpulsation. However, the prior art devices typically have delayed response times to changes in the treatment parameter settings. The prior art devices are also limited in their precision of pressure control. These limitations in the prior art devices are serious and unacceptable.

External counterpulsation has developed as a means of treating reduced cardiac output and circulatory disorder stemming from disease. Counterpulsation treatment involves the application of pressure, usually from distal to proximal portions of a patient's extremities, where such application is synchronized with heart rhythms. The treatment augments blood pressure, typically increasing pressure during the diastolic phase of the heart, as such treatment is known to relieve and treat medical conditions associated with reduced cardiac output. Clarence Dennis described an early hydraulic external counterpulsation device and method of its use in U.S. Pat. No. 3,303,841 (Feb. 14, 1967). Dr. Cohen, in American Cardiovascular Journal (30(10) 656-661, 1973) described another device for counterpulsation that made use of balloons which would sequentially inflate and deflate around the limbs of a patient to augment blood pressure. Similar devices using balloons have been described in Chinese patents CN 85200905 (U.S. Pat. No. 4,753,226); Chinese patents CN 88203328, and CN 1057189A.

A series of Zheng patents, including U.S. Pat. No. 4,753,226 (Jun. 28, 1988), U.S. Pat. No. 5,554,103 (Sep. 10, 1996), and U.S. Pat. No. 5,997,540 (Dec. 7, 1999) disclose counterpulsation devices employing sequential inflation of balloon cuffs around the extremities, wherein the cuffs are inflated by a fluid. All three Zheng patents disclose an external counterpulsation device where a series of air bladders are positioned within a rigid or semi-rigid cuff around the legs. The bladders are sequentially inflated and deflated with fluid, such that blood pressure is augmented in the patient. The Zheng '103 and Zheng '540 patents provide for cooled fluid and for monitoring of blood pressure and blood oxygen saturation; however, both retain a similar mechanism dependent on compression of fluid such as air. The Zheng '540 patent modifies the shape of the air bladder and cuffs, but retains a similar mechanism requiring rapid fluid distribution, influx and efflux through balloons in the cuffs.

There are several deficiencies with prior pulsation treatment devices. First, the required circuitous movement of fluid through the apparatus causes a delayed response to changes in pressure settings for the balloons or air bladders. Second, there is also a consequent inability to manipulate action of the cuffs with a high degree of precision. Third, many of the prior art devices require a relatively heavy and noisy compressor and fluid reservoirs for inflating and deflating the cuffs. Fourth, the prior devices lack portability due to their large size and weight, their reliance on a compressor, and their reliance on an electric power source exceeding 120 volt. There are also deficiencies in some of these devices with regard to patients being bounced up and down while undergoing pulsation treatment.

A need therefore exists for a pulsation treatment apparatus that provides very rapid response to changes in applied pressure settings, and that permits control of cuff pressure with a high degree of precision. Preferably, such a treatment apparatus will not require fluid filled balloons or air bladders, or require fluid reservoirs and compressors, and will not subject the patient to undesirable or unnecessary movement. Still more preferably, such a treatment apparatus will be relatively light weight, small, and portable, and will operate on a 120-volt source of electric power.

BRIEF SUMMARY OF THE INVENTION

The present invention addresses the aforementioned needs. According to one embodiment of the invention, an apparatus for use in counterpulsation treatment of a patient, wherein pressure is applied to the patient's blood vessels to stimulate blood flow, comprises a cuff to be received on a patient's extremity. The cuff has first and second ends. First and second electromechanical actuators are associated with the cuff and controllably operable to a plurality of positions within a range of positions. The range of positions ranges from an original position to a maximum constricted position. The actuators are disposed on opposite sides of the patient. The cuff applies maximum pressure to the patient's blood vessels to constrict the blood vessels in the maximum constricted position of the plurality of positions of the actuator. The cuff applies no pressure to the patient's blood vessels in the original position of the plurality of positions of the actuator. The actuator is controllably operable from the relaxed position to any of the positions within the range of positions on activation.

This invention is a mechanical pulsation apparatus for use in external pulsation, including counterpulsation or simultaneous pulsation, treatment of reduced cardiac output, congestive heart failure, angina pectoris, heart disease and other circulatory disorders. Counterpulsation has traditionally involved the application of sequential pressures on the lower legs, upper legs and hip areas through pneumatic cuffs placed on those regions. Application of pressure to the extremities has been timed to correlate with a patient's physiological rhythms, such as diastolic and systolic phases of the heart. This application of force by the cuff causes a retrograde wave back up the arteries toward the heart, whereby blood pressure is increased during the diastolic phase of the heart. The sequence of compressions could be reversed and force blood toward the feet. This enhanced diastolic pressure is recognized as medically beneficial for treatment of medical conditions relating to blood circulation. The present invention, however, does not make use of pneumatic or inflatable devices for application of pressure. Rather, the present invention utilizes an electromechanically controlled flexible cuff that on activation compresses and applies pressure to a patient's body. Rather than pneumatic or inflatable devices, the present invention uses the cuff to constrict a portion of the patient's body, typically the abdomen and/or the upper and/or lower legs. The cuff is designed to partially encircle an extremity such as a leg, arm or midsection of a patient's body. Electromechanical means for operation of the cuff is preferably one or more linear solenoid actuators mounted on a frame and connected to the cuff through a suitable linkage. Positive pressure from the cuff forces blood from the extremity toward the patient's heart during diastole. It is this augmentation of blood pressure during diastole that provides curative benefit from counterpulsation treatment. Typically, the cuff will release immediately prior to the systolic phase of the patient's heart.

Because the clinician may adjust the sequence in which the actuators are activated, blood can be forced away from the heart to a foot or hand. This is beneficial when treating a diabetic patient with poor blood circulation to these extremities.

It is therefore an object of the present invention to provide a pulsation, including counterpulsation or simultaneous pulsation, treatment apparatus that operates by electromechanical rather than by pneumatic means, and which can be precisely controlled by the operator or automated treatment program. It is a further object of the invention that the treatment apparatus transmit data regarding local pressure applied to the patient. It is a further object of the invention that the pressure applied to the patient by the apparatus be fully adjustable, such that the apparatus may apply fixed pressure, less than its maximum pressure, at times during operation. Other objects of the invention are apparent from the specification and claims as set forth below.

BRIEF DESCRIPTION OF THE DRAWINGS

For a more complete understanding of the present invention and the advantages thereof, reference is now made to the following Detailed Description of Example Embodiments of the Invention, taken in conjunction with the accompanying drawings, in which.

DETAILED DESCRIPTION OF EXAMPLE EMBODIMENTS OF THE INVENTION

Figure 1:
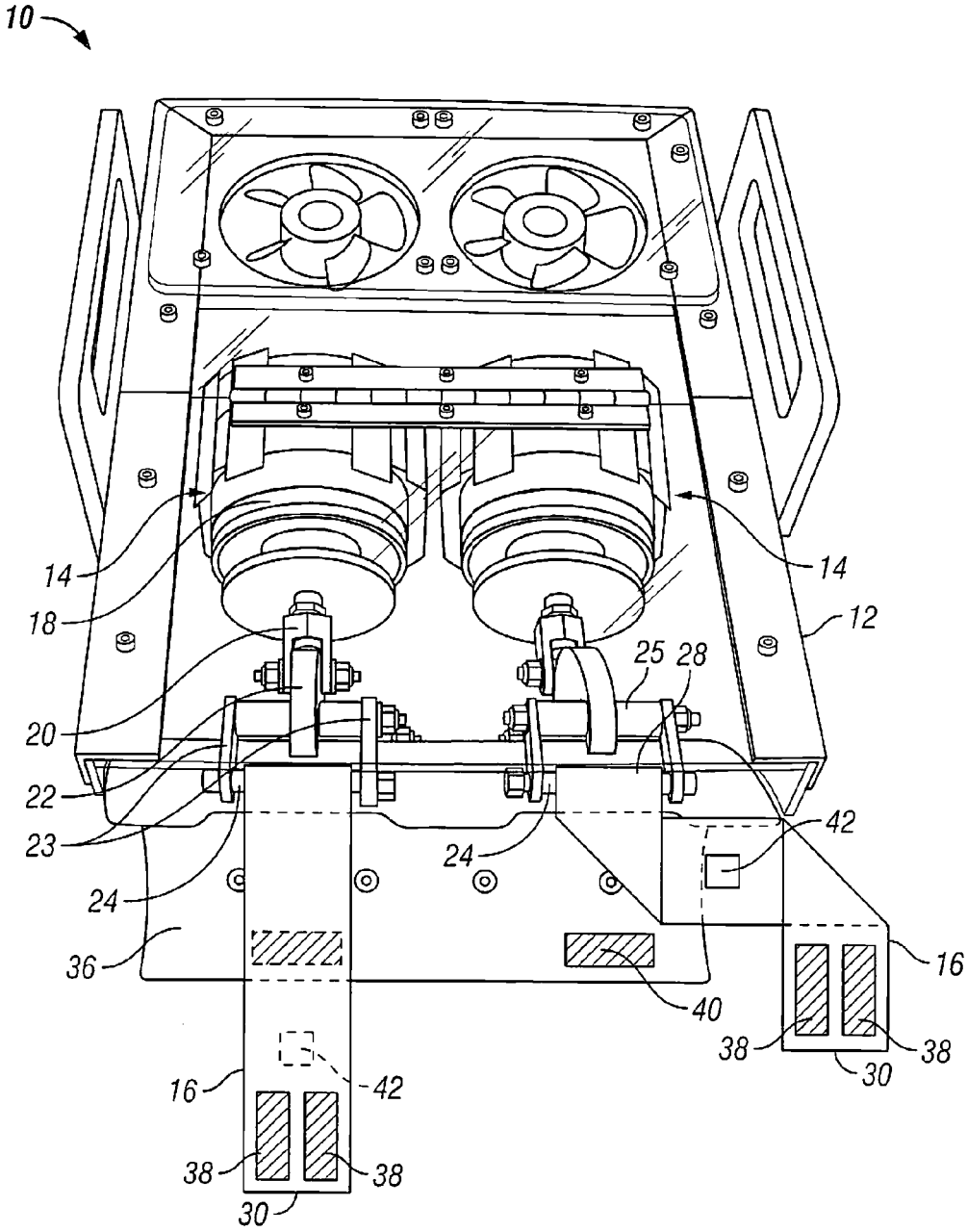
FIG. 1 is a top and front perspective view of a pulsation treatment apparatus of the invention for use on a patient's leg, with the actuators shown in their extended positions.

The invention and its advantages are best understood by referring to the drawings, like numerals being used for like and corresponding parts of the various drawings. In FIG. 1, there is shown in perspective view a pulsation treatment apparatus, generally designated 10, according to an example embodiment of the invention. Treatment apparatus 10 is used primarily for pulsation and counterpulsation treatment of a patient's upper or lower legs. Treatment apparatus 10 includes a frame 12, a pair of actuators 14, a pair of cuffs 16 associated with respective actuators 14, among other components described hereinbelow.

Figure 2:
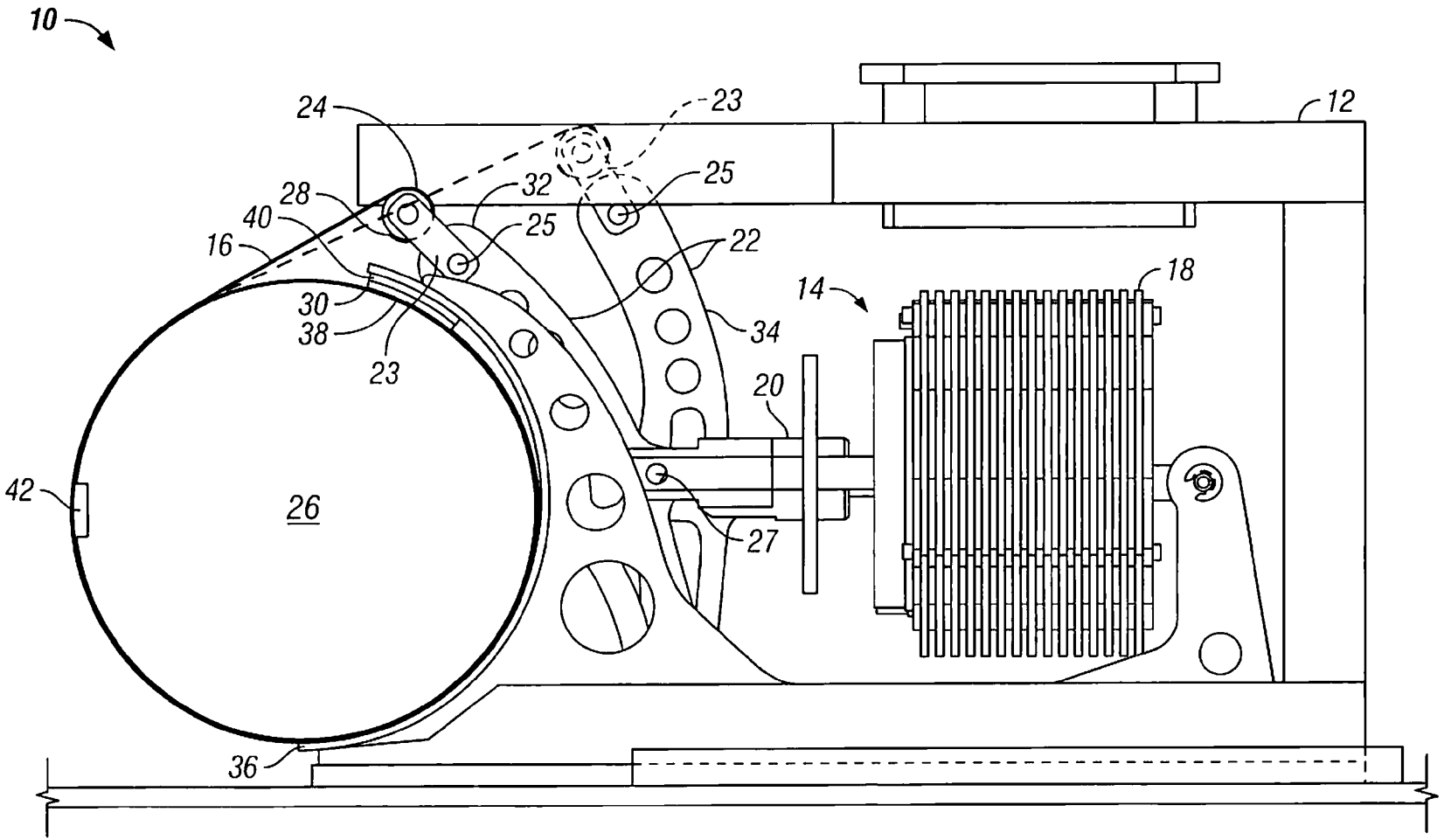
FIG. 2 is a side elevation view of the treatment apparatus of FIG. 1, as applied to a patient's leg.

FIG. 2 illustrates the use of treatment apparatus 10 for treating a patient's upper or lower leg 26. In the illustrated embodiment, actuator 14 is electromechanical, and includes electric solenoid 18, shaft 20, arm 22, arm extensions 23, and roller 24. Solenoid 18 is mounted within frame 12. Arm 22 is pivotally connected at its lower end to frame 12. Shaft 20 is connected to and driven axially and linearly by solenoid 18. Arm 22 is connected to and driven rotatably by shaft 20 through pin 27. Pin 27 connects shaft 20 to arm 22 at a location intermediate upper end of arm 22 and the lower end of arm 22. Roller 24 is rotatably connected to the upper end of arm 22 through a linkage 23, 25 made up of pin 25 connected to the upper end of arm 22 and arm extensions 23 connected at their lower ends to pin 25. Roller 24 is rotatably connected between the upper ends of arm extensions 23. The first end 28 of cuff 16 is fixed to roller 24.

Actuator 14 is electromechanical, and is controllably operable to a plurality of positions within a predetermined range of positions. The actuator 14 positions range from an original position to a maximum constricted position. Arm 22 is rotatably driven by shaft 20 to a plurality of positions within a range of positions, the range of positions of the arm corresponding to the range of positions of the actuator. The original position of actuator 14 corresponds to original position 32 of arm 22, and maximum constricted position of actuator 14 corresponds to maximum constricted position 34 of arm 22.

Cuff 16 is sized to partially encircle the patient's leg 26 peripherally. First end 28 of cuff 16 is removably attached to roller 24 on arm 22. Second end 30 of cuff 16 is removably attached to curved plate 36 of apparatus 10 by a hook and loop fastener system 38, 40. The hook and loop fastener system has a first fastener component 38 attached to the second end 30 of the cuff; and a second fastener component 40 attached to plate 36, as best seen in FIG. 1. Plate 36 is curved to conform generally to the patient's leg and is attached to the frame 12. In the embodiment illustrated in FIGS. 1-4, plate 36 is generally half-cylinder shaped.

Referring again to FIG. 2, in the maximum constricted position of the plurality of positions of actuator 14, cuff 16 applies a predetermined maximum pressure to the patient's leg and blood vessels therein to constrict the blood vessels. In the original position of the plurality of positions of actuator 14, cuff 16 applies zero pressure to the patient's blood vessels so as to not constrict them at all. Actuator 14 is controllably operable from the original position to any of the positions within the range of its positions on electrical activation.

In the embodiment of the invention illustrated in FIG. 1, cuff 16 is rectangular in shape when flat, similar to a wide strap. In alternative embodiments of the invention (not illustrated), cuff 16 is slightly trapezoidal or conical in shape when flat so as to better accommodate increasing or decreasing thicknesses of the patient's leg or other extremity. Cuff 16 is essentially like cuff 58 illustrated in FIGS. 8 and 9 and described below, except that cuff 16 does not include a cushion portion 56 at its center. A pressure relief valve (not illustrated) is attached to the bladder in cuff 16.

Referring to FIGS. 1 and 2, pressure sensor 42 is embedded in or attached to the surface of cuff 16. In one embodiment of the invention, pressure sensor 42 provides data to an external control unit (not illustrated) for manual or automatic adjustment of the pressure applied to the patient by cuff 16. Pressure sensor 42 detects the air pressure in cuff 16 which correlates to the degree of compression accomplished by cuff 16, and by the respective actuator 14 during operation. Pressure sensor 42 provides electronic feedback data to the operator or the computer. These data are then processed during treatment for possible adjustment of actuator and cuff operation.

Figure 3:
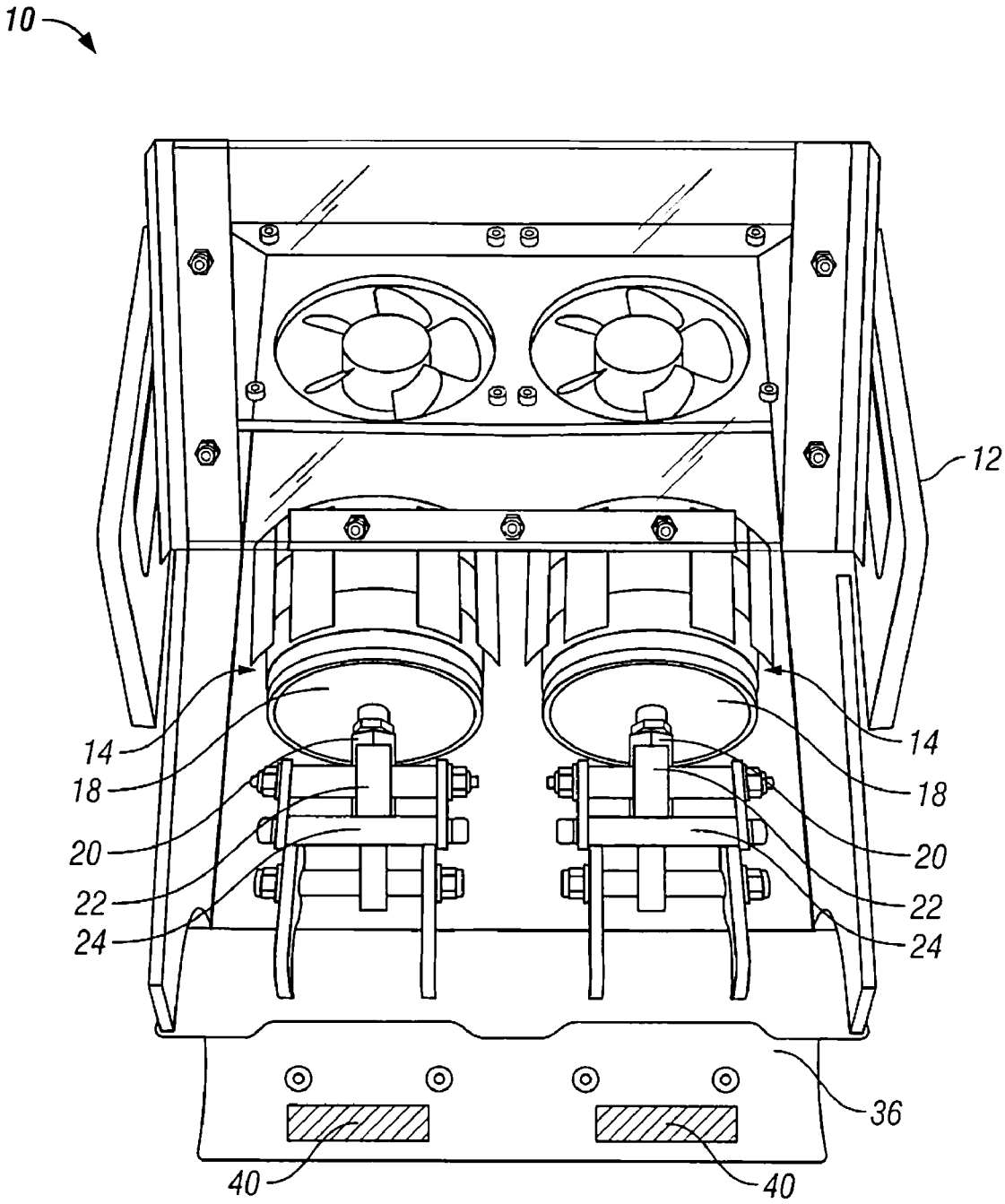
FIG. 3 is a top and front perspective view of the pulsation treatment apparatus of FIG. 1 with the actuators shown in their retracted positions.
Figure 4:
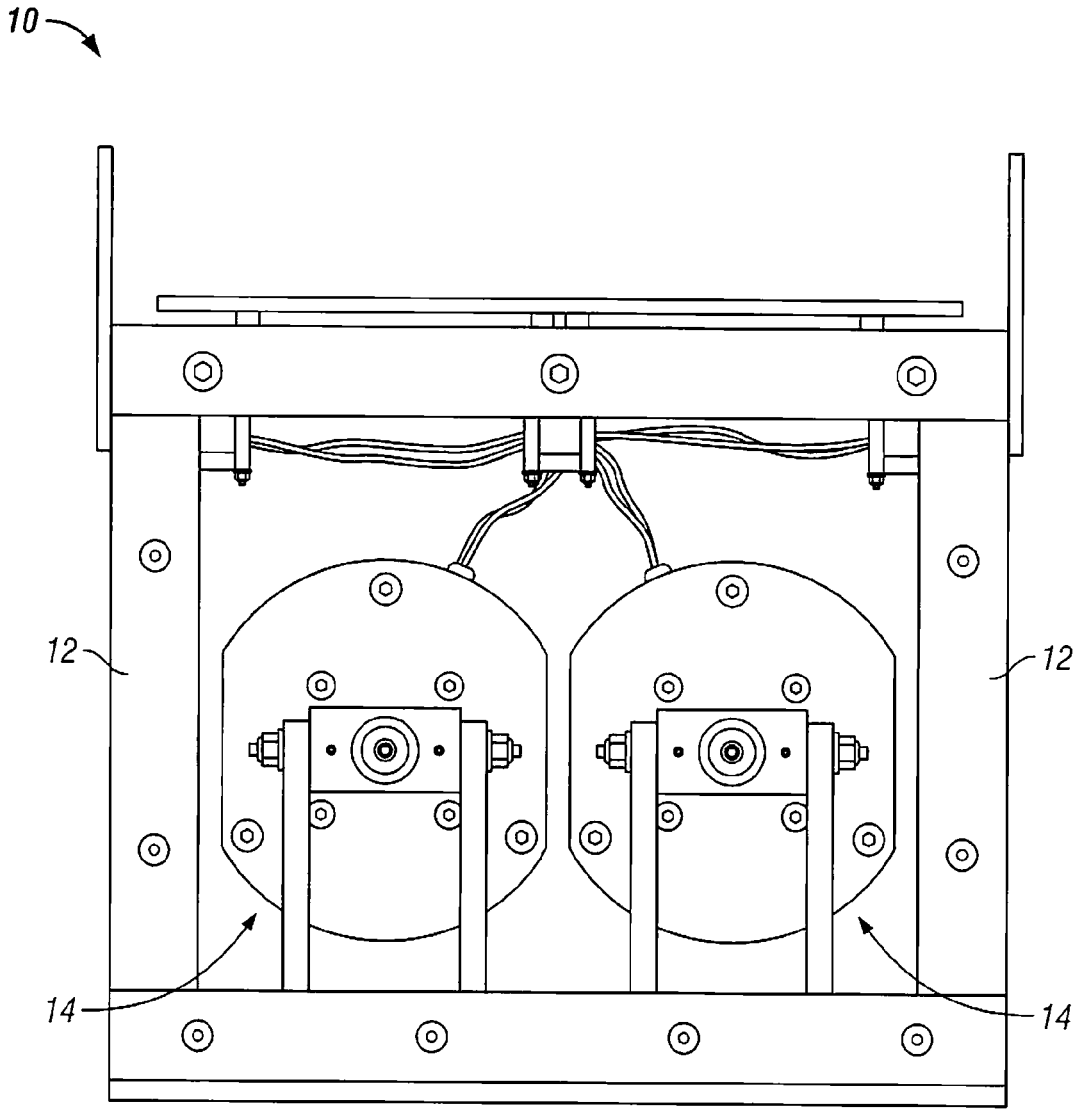
FIG. 4 is a rear elevation view of the treatment apparatus of FIG. 1.

In FIG. 1, actuators 14 are shown in their original positions, in which shafts 20 are extended and arms 22 are rotated forward, toward the patient's leg 26. In this position, cuff 16 applies no pressure on the patient's blood vessels. In FIG. 3, actuators 14 are shown in their maximum constricted positions, in which shafts 20 are retracted back toward solenoids 18, and arms 22 are rotated backward, away from the patient's leg. FIG. 4 is a rear elevation view of treatment apparatus 10.

Figure 5:
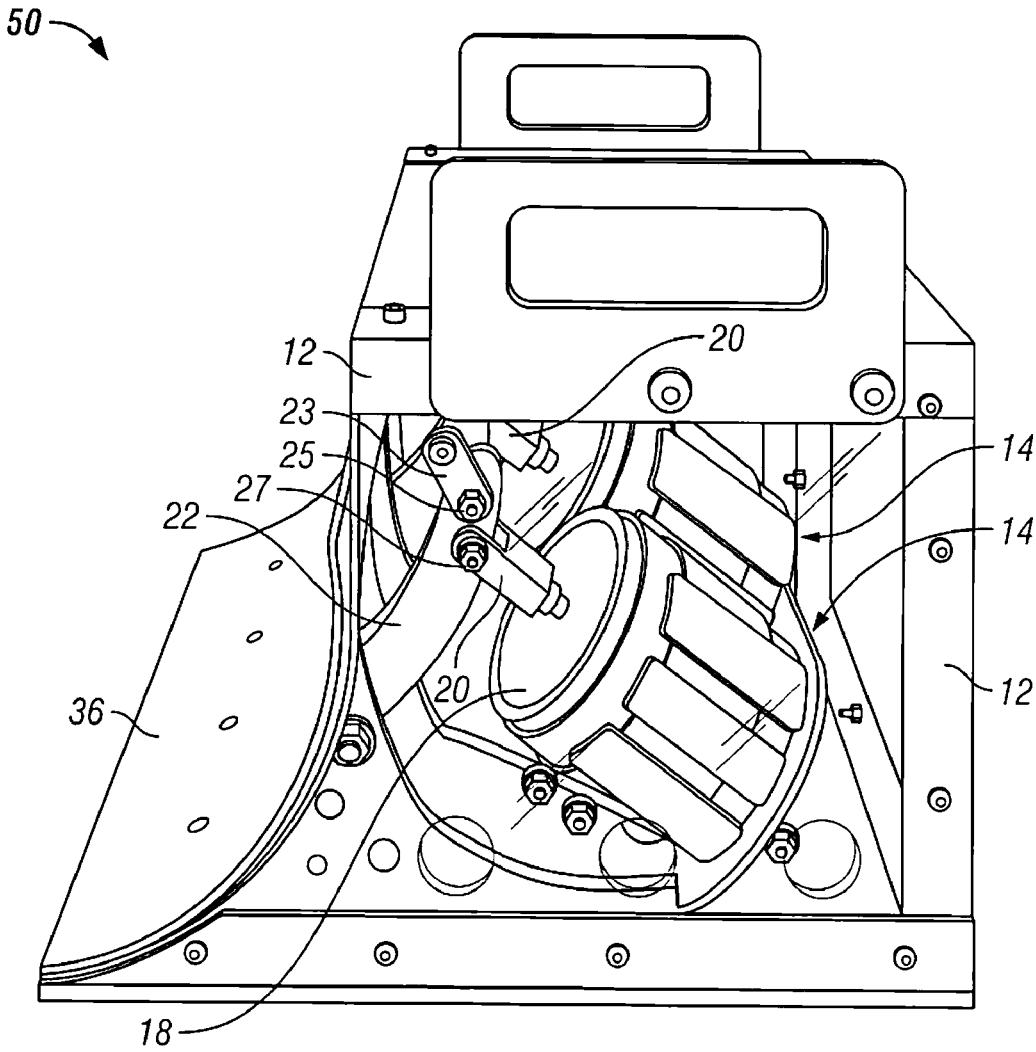
FIG. 5 is a side and top perspective view of a portion of a pulsation treatment apparatus of the invention for use on a patient's hips.
Figure 7:
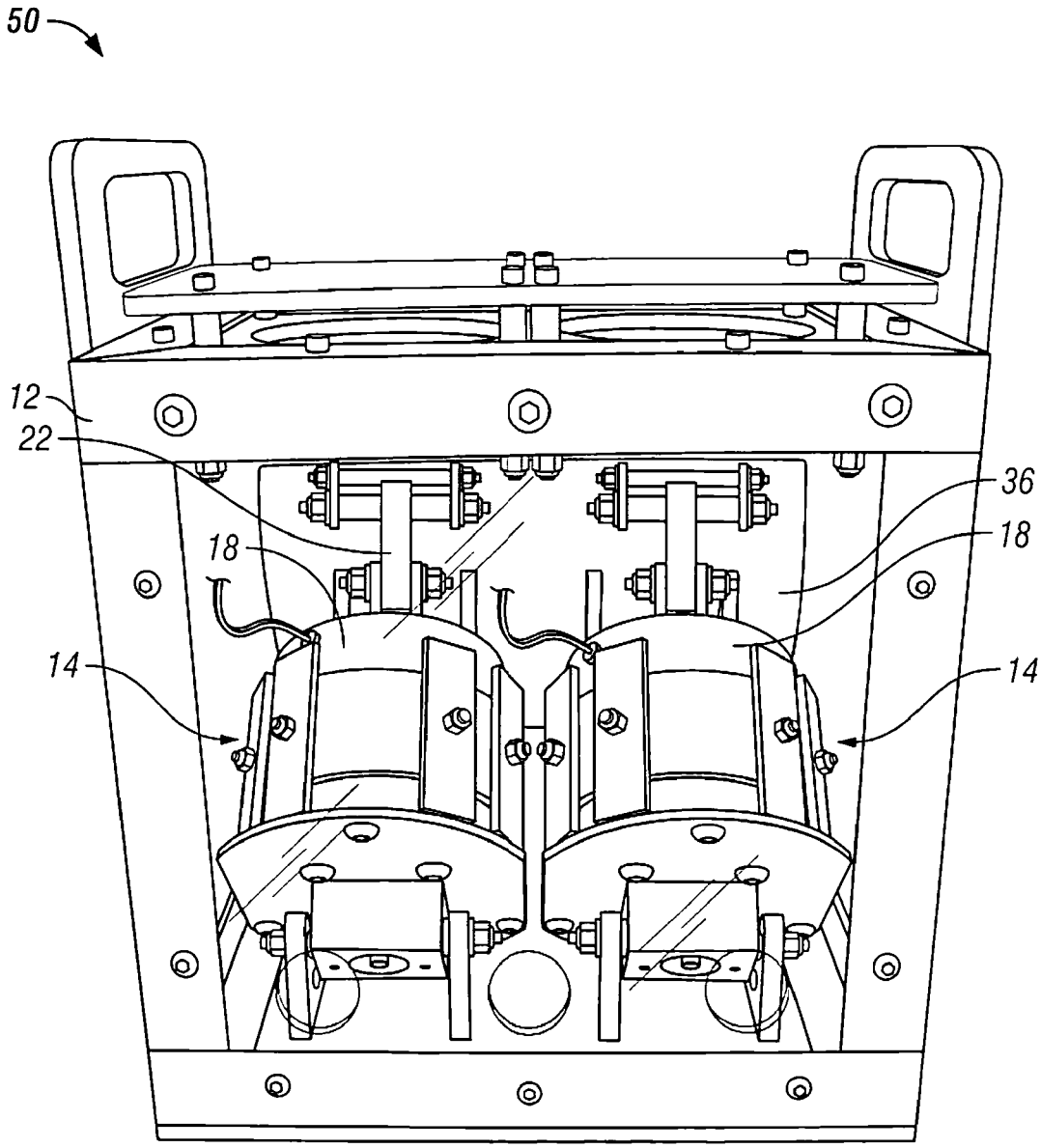
FIG. 7 is a rear elevation view of the treatment apparatus of FIG. 5.

Referring next to FIG. 5, there is shown in perspective view a portion of a pulsation treatment apparatus, generally designated 50, according to a second example embodiment of the invention. Treatment apparatus 50 is used primarily for pulsation and counterpulsation therapy of a patient's hip area. Treatment apparatus 50 is like apparatus 10 described above in many respects. One primary difference is that actuators 14 in apparatus 50 are tilted upward, whereas actuators 14 in apparatus 10 are generally horizontal in orientation. In the embodiment of treatment apparatus 50 illustrated in FIG. 5, the axes of solenoids 18 and shafts 20 of actuators 14 are approximately 45 degrees from horizontal. However, in alternative embodiments, actuators 14 are tilted at other angles as best suited to the specific application of the invention. FIG. 7 is a rear elevation view of treatment apparatus 50.

Figure 6:
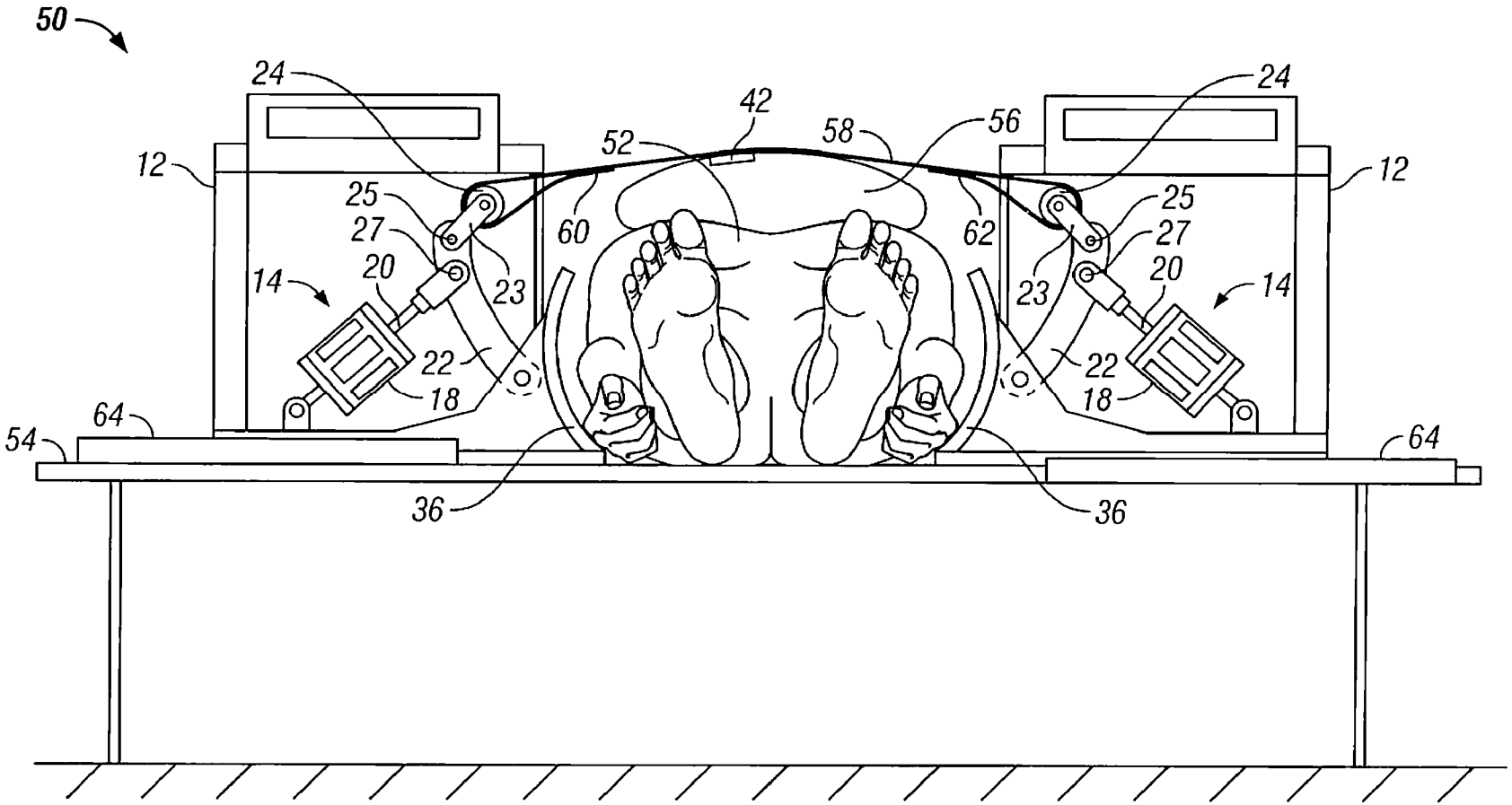
FIG. 6 is a side elevation view of the entire treatment apparatus of FIG. 5, as applied to a patient's hip area.

FIG. 6 illustrates the use of treatment apparatus 50 for providing a patient's hip area with pulsation or counterpulsation treatment, according to an example embodiment of the invention. In the illustrated embodiment, the patient 52 lies on his back on a treatment table 54. Treatment apparatus 50 includes a pair of actuators 14 disposed on opposite sides of the patient near the patient's hips. The actuators 14 face the patient 52 and each other. Cuff 58 includes a thickened portion 56 that is placed over the patient's lower abdomen.

The opposite ends 60 and 62 of cuff 58 are connected to the upper ends of arms 22 through linkages 23, 25. The linkages are made up of pins 25 connected to the upper ends of arms 22, and arm extensions 23 rotatably connected at their lower ends to pins 25. Rollers 24 are rotatably connected between the upper ends of arm extensions 23. The ends 60 and 62 of cuff 58 pass around rollers 24 of actuators 14 and are fastened to cuff 58 by hook and loop fasteners attached to cuff 58 or by other suitable fasteners. Cuff 58 thus applies pressure to the patient through cushion 56.

Actuator frames 12 are slidably mounted on treatment table 54 for sliding movement toward and away from the patient 52. The lower portions of actuator frames 12 slide laterally within channel guides 64. Guides 64 also restrain treatment actuators 14 from vertical movement with respect to table 54 when cuff 58 is tensioned by actuators 14. In an alternative embodiment (not illustrated), only one of actuator frames 12 is slidably mounted, the other actuator frame being fixed in place on treatment table 54. In other alternative embodiments (not illustrated), actuators 14 are restrained from vertical movement by being affixed in other ways to treatment table 54, or by being affixed to one another by a rigid or flexible connecting member (not illustrated) passing under the patient.

In other respects of construction and operation, treatment apparatus 50 for hip therapy is like treatment apparatus 10 for leg therapy described above. The description above with respect to the similar features is therefore not repeated here.

Figure 8:
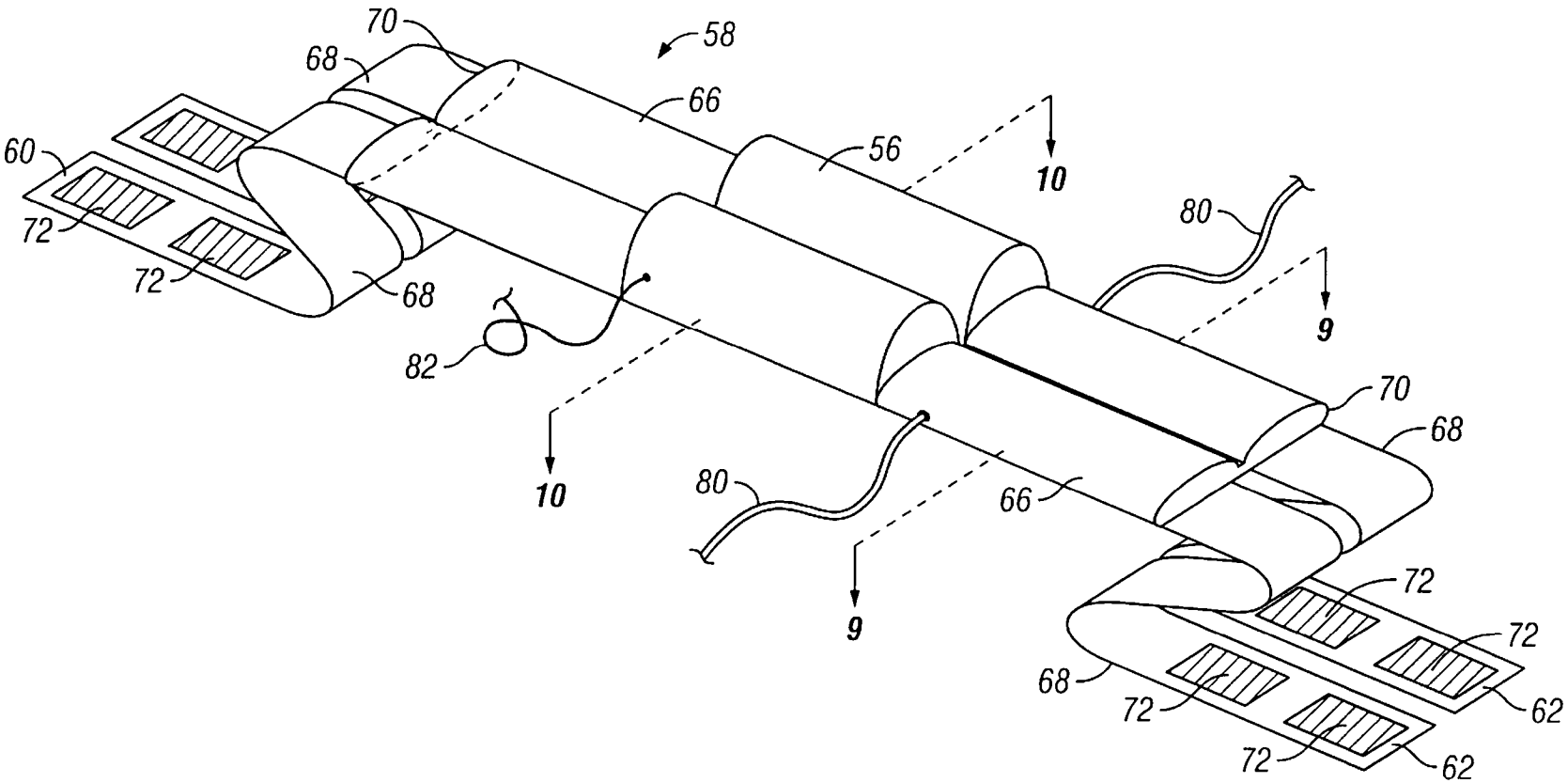
FIG. 8 is a perspective view of a cuff for the treatment apparatus of FIG. 5.

Referring next to FIG. 8, cuff 58 is made up of two side portions 66 connected by cushion portion 56 at the center of cuff 58. A pair of straps 68 are attached to each outer end 70 of side portions 66 of cuff 58. Hook and loop fasteners 72 are attached near the outer ends of straps 68 for attaching straps 68 to rollers 24 of actuators 14.

Figure 9:
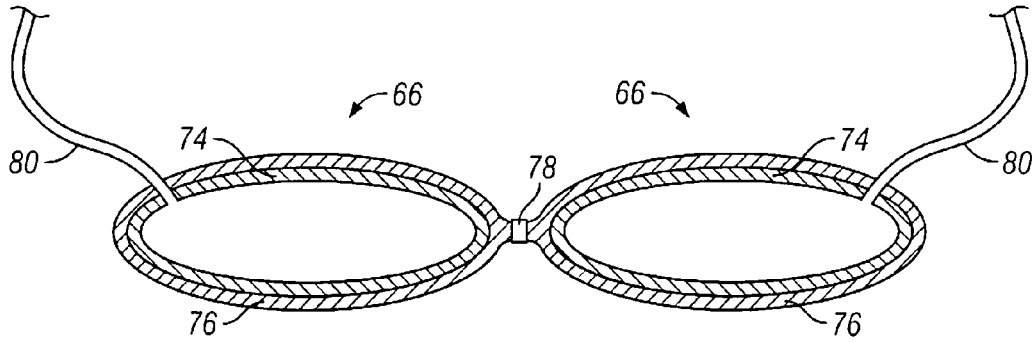
FIG. 9 is a cross-sectional view of the cuff of FIG. 8, taken at section 9-9 in FIG. 8.

Referring to FIG. 9, side portions 66 of cuff 58 are made up of two inflatable rubber bladders 74. Bladders 74 extend the lengths of side portions 66 and are enclosed by a fabric cover 76. In one embodiment of the invention, fabric cover 76 comprises nylon, as sold by Dupont Corporation under the tradename Cordura. Cover 76 is stitched along its center seam 78. As seen in FIGS. 8 and 9, each bladder 74 is inflated with air and deflated through a flexible air hose 80. Air hoses 80 supply air to bladders 74 from a a hand pump (not illustrated).

Figure 10:
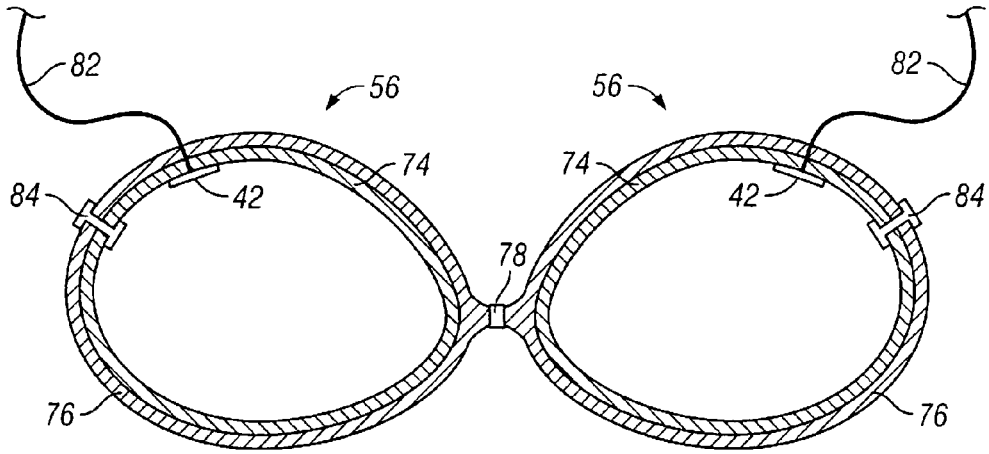
FIG. 10 is a cross-sectional view of the cuff of FIG. 8, taken at section 10-10 in FIG. 8.

Referring to FIG. 10, cushion portion 56 of cuff 58 is also made up of inflatable rubber bladders 74 enclosed by fabric cover 76. However, bladders 74 are much thicker in cushion portion 58 than they are in side portions 66, thereby providing a cushioning effect to the patient when inflated with air. The portions of bladders 74 within cushion portion 56 are in fluid communication with the portions of bladders 74 in side portions 66 of cuff 58. Therefore, inflation of side portions 66 through air hoses 80 also inflates cushion portion 58. Air pressure sensors 42 are installed on the interior of bladders 74 in cushion portion 56. Pressure signal wires 82 lead from pressure sensors 42 to the signal processor (not shown) for treatment apparatus 50. Pressure relief valves 84 are also installed on the interior of bladders 74 in cushion portion 56. Pressure relief valves 84 prevent damaging overcompression of the patient by cuff 58.

Cuff 16 for leg pulsation treatment apparatus 10 is like cuff 58 described above, except that cuff 16 does not have a center cushion portion 56. The inflatable bladders of cuff 16 are therefore uniform in thickness over their entire lengths.

The invention includes a method of treating a patient's medical condition using pulsation or counterpulsation wherein pressure is applied to and released from a patient's blood vessels to stimulate blood flow correlated with the patient's physiological data based on data received from at least one physiological measuring device. This method includes (1) applying a cuff to a patient. The cuff has at least one electromechanical actuator connected to it. The actuator is controllably operable to a plurality of positions within a range of positions. The actuator positions range from an original position to a maximum constricted position. The cuff applies maximum positive pressure to the patient's blood vessels to constrict the blood vessels in the maximum constricted position of the plurality of positions of the actuator. The cuff applies no pressure to the patient's blood vessels in the original position of the plurality of positions of the actuator. The electromechanical actuator unit is controllably operable from the original position to any of the positions within the range of positions on activation. The electromechanical actuator unit is operable at variable frequencies. At least one such variable frequency is responsive to at least one type of data from a physiological measuring device. In one embodiment of this method, the cuff has a pressure sensor for communicating with an external processor.

The method includes the further steps of (2) applying medical devices to the patient to detect physiological data; (3) detecting physiological data from the patient through use of the medical devices; (4) transmitting the physiological data electronically from the medical devices to a processor; (5) electronically processing the physiological data to determine when the patient's heart is in a diastolic or a systolic phase; (6) electronically timing the activation of each electromechanical cuff to correlate with the phases of the patient's heart; and (7) modifying the timing of the activation of the plurality of electromechanical cuffs according to changes in the physiological data affected by the activation.

A patient who is to be given pulsation treatment lies down on his back on treatment table 54. He places his legs against curved plates 36 of leg treatment apparatuses 10. Cuffs 16 of apparatuses 10 are placed around his upper and lower legs, as seen in FIG. 2. Hip treatment apparatuses 50 are moved together so that their plates 36 are brought into contact with the patient's hips, as seen in FIG. 6. Cuff 58 is then placed over the patient's lower abdomen, and ends 60 and 62 of cuff 58 are secured to rollers 24 of apparatuses 50 so that the slack is removed from cuff 58. Hand pumps are then operated to inflate bladders 74 in all the cuffs. Inflation of bladders 74 applies a gentle pressure to the patient's legs and lower abdomen.

In operation of pulsation treatment apparatus 10 or apparatus 50, when actuators 14 are electrically energized, actuator shafts 20 retract back toward the actuators, thereby rotating arms 22 away from the patient. This rotation of arms 22 tensions cuffs 16 or 58, thus applying pressure to the patient according to predetermined medical treatment parameters. The pressure applied to the patient varies in direct proportion with the degree of rotation of arms 22 produced by actuators 14, which in turn varies with the electric current or voltage supplied to actuators 14. The pressure applied to the patient by cuffs 16 or 58 is reduced by deenergizing actuators 14, which in turn extends shafts 20 and rotates arms 22 back toward the patient, relaxing cuffs 16 or 58.

The treatment parameters are correlated with the patient's physiological data, such as diastolic and systolic phases of the heart, to augment blood pressure as necessary. The pressure strength, pressure and relaxation duration, and delay between compressions can be varied separately for each cuff and individual actuator used in a treatment session. The actuators can apply pressure to the patient in many combinations of sequence, amounts of pressure, and duration. The preferable manner is where graded pressure is applied sequentially. Each actuator and respective cuff may also release pressure at variable sequences and by varying degrees. The actuators can relax the cuffs in various manners; the preferred manner is to release them all at once.

Graded pressure means that each actuator is set to apply a specific, but not necessarily identical, amount of pressure to the patient. For example, the actuators for a patient's calves may be set to apply pressure at a greater strength than the actuators for the patient's thighs. Actuators are preferably adjusted so that pressure will increase or decrease from distal to proximal direction on a patient. Pressure on a patient can be applied by one actuator at a time, in any sequence, and at any pressure within the treatment parameters.

An individual actuator may be removed from a sequence of activations, or can be set independently so that one cuff applies pressure more frequently per period of time than will another cuff. Each individual actuator will preferably operate in sequence, whether or not there are gradations in pressure from actuator to actuator.

Graded sequential pressure involves variations in constriction force or pressure from actuator to actuator, and where actuators operate in sequence. For example, actuators for a patient's calves may be set to apply greater pressure than actuators for the patient's hips. In addition to graded pressure, the actuators are generally set to activate in sequence starting from the patient's calves and moving upward to the patient's hip.

The cuffs apply pressure preferably in sequence on a patient from a distal to proximal direction generally with increments in the range of 35.0 to 50.0 milliseconds between initial activation of separate sequential cuffs. All cuffs preferably operate within a compression strength range of zero to 7.0 pounds of pressure per square inch.

In various embodiments of the invention, the length and diameter of curved plate 36 differs to accommodate different body shapes and sizes. For instance, curved plate 36 may be sized to accept a calf, thigh, forearm, or upper arm of an infant, child, or adult patient.

While more than one cuff can be operated simultaneously, each of the cuff actuators can be operated separately with different or identical compression sequences, strengths, and delays. For instance, with the present invention, it would be possible to cause a particular cuff to constrict more frequently in a set period of time than the other cuffs. Additionally, the present invention can advantageously apply pressure to an extremity almost instantaneously from the time the activation signal is sent due to its electromechanical rather than pneumatic operation. The applied pressure can also be varied with a high degree of precision with the present invention. Instead of simultaneous deflation of all cuffs at systole, the present invention, which does not require deflation, can vary the degrees of pressure on each cuff during systole. Because the apparatus of this invention does not rely on inflation or deflation of the cuffs, it can more gradually reduce the pressure applied by each individual cuff.

In an example embodiment of the invention, cuff 16 of leg treatment apparatus 10 is 6 inches wide, 24 inches long and 1 inch thick. In one embodiment, cuff 58 of hip treatment apparatus 50 is 6 inches wide, 24 inches long, and 3 inches thick.

In one embodiment, curved plate 36 of leg treatment apparatus 10 is 10 inches in diameter, 10 inches long, and ¼ inch thick. In one embodiment, curved plate 36 of hip treatment apparatus 50 is 12 inches in diameter, 10 inches long, and ¼ inch thick.

In one embodiment, solenoid 18 is a snap type electromechanical solenoid, as manufactured by Densitron Co., as model number 874C. Pressure sensor 42 is an air pressure sensor, as manufactured by Freescale Co., as part number MPX4250A.

Compression of the cuffs may be correlated with physiological data including, but not limited to EKG, plethysmograph, cardiac output, heart rate, blood pressure, heart stroke volume, blood oxygen levels, systole and diastole. A variety of devices in the medical industry are used to detect and electrically transmit this physiological data from a patient. After such data is collected, it is typically processed within pulsation parameters to determine the proper sequence of cuff activation. Such data is typically received and processed by computer with cardiac pulsation treatment software. Typically a computer processes the patient's electronic physiological data as well as electronic feedback data obtained from pressure sensors 42 installed in the cuffs. Treatment parameters can be changed based on either input from the clinician or from the processor program.

Figure 11:
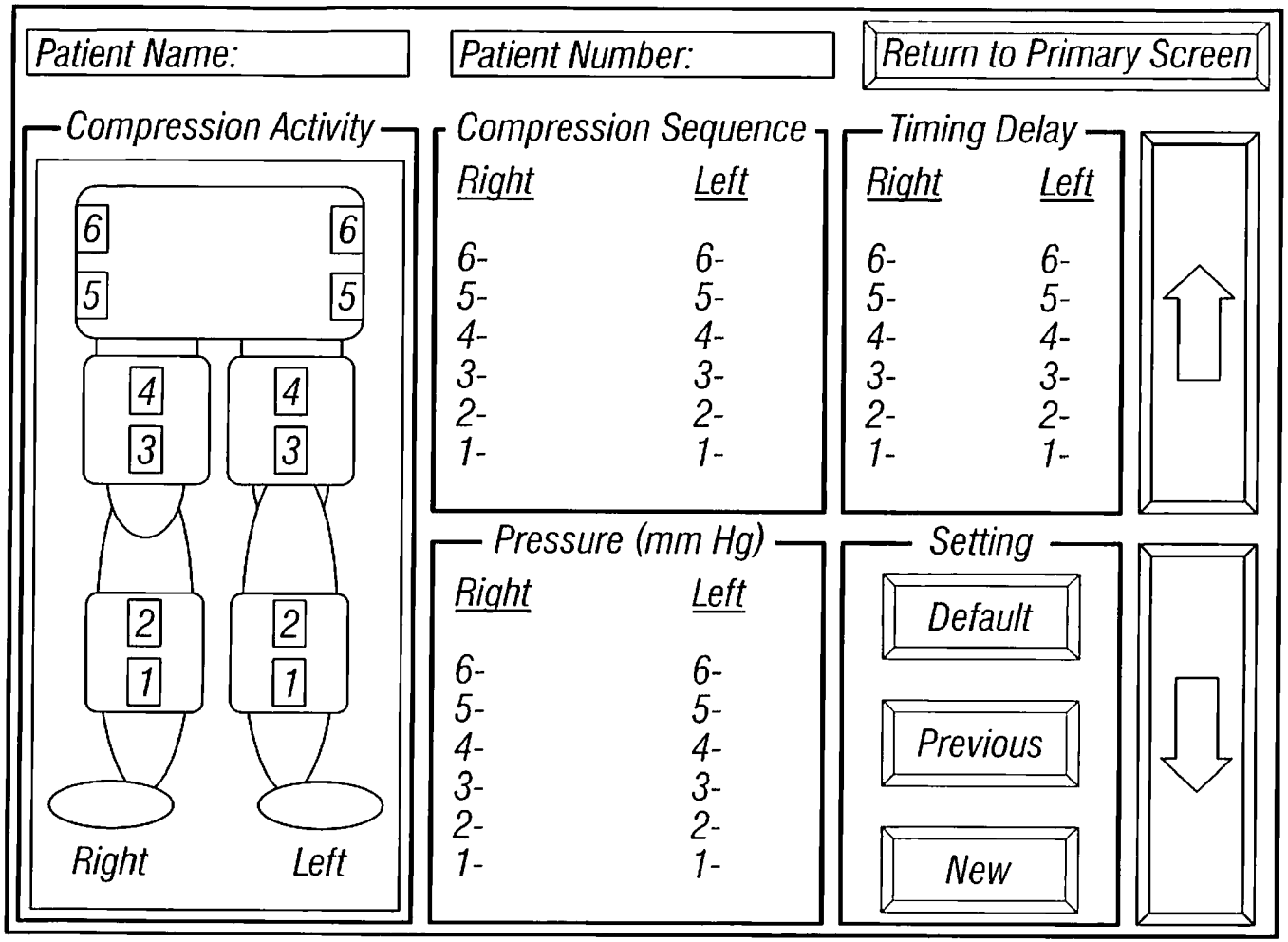
FIG. 11 is the display of a computer monitor screen of the pulsation treatment apparatus of this invention.

In one embodiment of the invention, the computer or processor interfaces with an interactive touch screen video monitor, as illustrated in FIG. 11. During a counterpulsation treatment session, the monitor displays the patient's physiological indicators, such as systole, diastole, blood pressure, oxygen saturation of the blood, ECG, stroke volume, diastolic to systolic ratios, cardiac output, and heart rate. Through the monitor, the attending physician or nurse monitors and controls the compression pressure, sequence, frequency of activation, and timing delay for each of the actuators, and may deactivate any of the actuators from the treatment program. The monitor also tracks activation status for each of the cuffs, showing for each cuff, data including but not limited to compressions, sequence with other cuffs, and strength of each compression. The attending physician or nurse is thus able to maintain optimal benefit of the counterpulsation treatment. This is important as it is known that any patient's responsiveness or tolerance to treatment can change in a relatively short period of time during treatment. The user may also obtain printouts of monitored data through the interactive monitor.

The pulsation and counterpulsation apparatuses of the present invention, and many of their intended advantages, will be understood from the foregoing description of example embodiments, and it will be apparent that, although the invention and its advantages have been described in detail, various changes, substitutions, and alterations may be made in the manner, procedure, and details thereof without departing from the spirit and scope of the invention, as defined by the appended claims, or sacrificing any of its material advantages, the forms hereinbefore described being merely exemplary embodiments thereof.

I claim:

1. An apparatus for use in pulsation treatment of a patient wherein pressure is applied to the patient to stimulate blood flow, comprising:

a cuff to be received on a patient's body member, the cuff having a first cuff end and a second cuff end;

at least one electromechanical actuator associated with the cuff and controllably operable to a plurality of positions within a range of positions, the range of positions ranging from an original position to a maximum constricted position;

the actuator controllably operable from the original position to any of the positions within the range of positions the actuator including a solenoid and a shaft connected to and driven by the solenoid;

an arm rotatably connected to and driven by the shaft;

the shaft extending from the solenoid to the arm the arm having an arm connection end and an arm distal end:

the shaft connecting the arm intermediate the arm connection end and the arm distal end;

a frame;

the arm connection end being pivotally mounted on the frame;

the solenoid mounted on the frame;

the arm driven by the shaft to a plurality of positions within a range of positions, the arm distal end rotatable in relation to the arm connection end responsive to said actuator plurality of positions;

a curved plate attached to the frame;

said plate operable to support at least a segment of the patient;

the first cuff end attached to the arm distal end; and the second cuff end directly attached to the plate.

2. The apparatus of claim 1, wherein said frame operable to slidably mount on a patient treatment table.

3. The apparatus of claim 1, wherein said frame having a lower portion operable to slide within channel guides.

4. The apparatus of claim 1, further including;

a roller:

said roller rotatably connected to the arm distal end; and said roller connected to the cuff first end.

5. The apparatus of claim 4, wherein:

the roller rotatably connected to the arm distal end through a linkage;

said linkage comprising a pin connected to the arm distal end;

at least one arm extension connected to the pin; and the roller rotatably connected to the arm extension.

6. The apparatus of claim 1, wherein the cuff second end is removably attachable to the actuator.

7. The apparatus of claim 6, wherein the cuff second end is removably attachable to the plate.

8. The apparatus of claim 7, wherein the cuff second end is removably attachable to the plate by a hook and loop fastener system having a first fastener component and a second fastener component;

the first fastener component attached to the cuff second end; and the second fastener component attached to the plate.

9. The apparatus of claim 1, wherein the plate is curved to conform generally to a body extremity.

10. The apparatus of claim 9, wherein the plate is generally half-cylinder shaped.

11. The apparatus of claim 1, wherein:

the cuff contains a pressure sensor;

said pressure sensor operably connected to an external control unit for providing pressure data.

12. The apparatus of claim 1, wherein the electromechanical actuator is operable at variable frequencies, at least one said frequency being responsive to at least one type of data from a physiological measuring device.

13. An apparatus for use in pulsation treatment of a patient wherein pressure is applied to the patient to stimulate blood flow, comprising:

a first actuator and a second actuator;

each actuator including an arm, a solenoid and a shaft, the shaft connected to and driven by the solenoid;

each arm rotatably connected to and driven by the shaft;

the shaft extending from the solenoid to the arm each arm having an arm connection end and an arm distal end;

each shaft connecting to the arm intermediate the arm connection end and the arm distal end;

each actuator supported on a frame;

said solenoid of each actuator mounted on the frame;

each arm connection end pivotally connected to the corresponding frame;

each arm rotatable in relation to the corresponding frame;

each arm driven by the corresponding shaft to a plurality of positions within a range of positions;

each arm distal end rotatable in relation to the corresponding arm connection end responsive to said corresponding actuator plurality of positions;

a curved plate attached to each frame;

each plate operable to support at least a segment of the patient;

a cuff having a first cuff end and a second cuff end;

said first cuff end connected to the first actuator arm distal end; and said second cuff end connected to the second actuator arm distal end.

14. The apparatus of claim 13, wherein each frame is operable to slidably mount on a patient treatment table.

15. The apparatus of claim 14, further including:

a roller rotatably connected to each arm distal end;

said first cuff end connected to the first actuator roller; and said second cuff end connected to the second actuator roller.

16. The apparatus of claim 15, wherein:

each roller is rotatably connected to its respective arm distal end through a linkage;

each linkage comprising a pin connected to its respective arm distal end;

at least one arm extension connected to the pin; and the roller connected to the arm extension.

17. The apparatus of claim 13, wherein each actuator plate is curved to conform generally to a body component of a human.

18. The apparatus of claim 17, wherein the plates are generally half-cylinder shaped.

19. The apparatus of claim 13, wherein:

the cuff contains a pressure sensor; and said pressure sensor operably connected to an external control unit for providing pressure data.

20. The apparatus of claim 13, wherein the actuators are affixed to a patient table.

21. The apparatus of claim 13, wherein the actuators are affixed to one another by a connecting member.

22. The apparatus of claim 13, wherein each actuator is slidably mountable on a patient table.

23. A method of treating a medical condition using counterpulsation, the method comprising the steps of:

applying a cuff to a patient, the cuff having at least one electromechanical actuator connected thereto the electromechanical actuator comprising a frame, an arm, an arm connection end pivotally mounted on the frame, an arm distal end rotatable in relation to said arm connection end, a solenoid mounted on the frame, a shaft extending from the solenoid to the arm, the shaft pivotally connecting the arm at a position intermediate the arm connection end and the arm distal end, a curved plate attached to the frame and formed to engage at least part of the patient, the frame slideable to engage the curved plate with the patient, the cuff having a first cuff end connected to the arm distal end, the cuff having a second cuff end directly connected to the plate;

applying medical devices to the patient to detect physiological data;

detecting physiological data from the patient through use of the medical devices;

transmitting the physiological data electronically from the medical devices to a processor;

electronically processing the physiological data to determine when the patient's heart is in a diastolic or a systolic phase;

activating the electromechanical actuator and electronically timing the activation thereof to correlate with the phases of the patient's heart;

modifying the timing of the activation of the plurality of electromechanical cuffs according to changes in the physiological data affected by the activation.

* * * * *